US008035047B2

(12) United States Patent
Raabe et al.

(10) Patent No.: US 8,035,047 B2
(45) Date of Patent: Oct. 11, 2011

(54) REDUCED MATERIAL PLUG-ON JAW WITH SYMMETRICAL SPRING FOR A CIRCUIT BREAKER

(76) Inventors: Rodney D. Raabe, Swisher, IA (US); David K. Schroeder, Marion, IA (US)

( * ) Notice: Subject to any disclaimer, the term of this patent is extended or adjusted under 35 U.S.C. 154(b) by 732 days.

(21) Appl. No.: 11/805,200

(22) Filed: May 22, 2007

(65) Prior Publication Data

US 2008/0289938 A1 Nov. 27, 2008

(51) Int. Cl.
*H01H 1/00* (2006.01)
*H01H 9/00* (2006.01)

(52) U.S. Cl. ..... 200/238; 200/250

(58) Field of Classification Search ..... 200/237, 200/238

See application file for complete search history.

(56) References Cited

U.S. PATENT DOCUMENTS 3,383,486 A * 5/1968 Powell ..... 200/250
3,566,318 A 2/1971 Gelzheiser et al. ..... 335/39
3,683,107 A * 8/1972 Camras ..... 386/32
3,908,110 A * 9/1975 Heft ..... 219/121.69
3,999,103 A 12/1976 Misencik et al. ..... 317/18 D
4,144,554 A * 3/1979 Erickson ..... 361/637
4,266,210 A 5/1981 Mrenna et al. ..... 335/201
6,265,680 B1 * 7/2001 Robertson ..... 200/293
6,323,448 B1 * 11/2001 Seymour et al. ..... 200/237

OTHER PUBLICATIONS

Merlin Gerlin Square D Telemecanique—Table of Contents (26 pages)—Schneider Electric (Printed on Apr. 30, 2007).

Square D QO® Plug-On Circuit Breaker Having a Full Jaw (6 pages), Photographs 1-6 (Photographs dated May 1, 2007).

* cited by examiner

*Primary Examiner* — Renee Luebke
*Assistant Examiner* — Lheiren Mae Caroc

(57) ABSTRACT

A circuit breaker includes a stationary contact, a plug-on half jaw, and a jaw spring. The plug-on half jaw is electrically coupled to the stationary contact and has a single terminal end for receiving a bus bar. The jaw spring is operatively coupled to the half jaw and has a bridge portion connecting two symmetrical spring legs.

17 Claims, 5 Drawing Sheets

REDUCED MATERIAL PLUG-ON JAW WITH SYMMETRICAL SPRING FOR A CIRCUIT BREAKER

FIELD OF THE INVENTION

This invention is directed generally to an electrical circuit breaker, and, more particularly, to a plug-on half jaw and symmetrical jaw spring for a circuit breaker.

BACKGROUND OF THE INVENTION

Circuit breakers are well known in the art, and are designed to trip in response to an electrical interruption event caused by an overload, short circuit, or thermal runaway condition, thereby opening the circuit to which the circuit breaker is connected and reducing the possibility of damage to the conductor wires or the loads connected to the circuit breaker. A circuit breaker can be reset (either manually or automatically) to resume power flow to the loads.

Some circuit breakers contain a plug-on full jaw, which is made of copper, that is coupled with a jaw spring for mechanically securing a bus bar to the circuit breaker. The full jaw also electrically couples the bus bar to a stationary contact of the circuit breaker. One problem associated with the full jaw is that its inherent design of having two terminal ends considerably increases the material cost.

What is needed, therefore, is a circuit breaker having a plug-on device that reduces material cost.

SUMMARY OF THE INVENTION

In one implementation, a circuit breaker includes a stationary contact, a plug-on half jaw, and a jaw spring. The plug-on half jaw is electrically coupled to the stationary contact and has a single terminal end for receiving a bus bar. The jaw spring is operatively coupled to the half jaw and has a bridge portion connecting two symmetrical spring legs.

In an alternative implementation, a method of assembly for a circuit breaker includes electrically coupling a plug-on half jaw to a stationary contact, the half jaw having a single terminal end for receiving a bus bar. The half jaw is mounted in a circuit breaker base. A jaw spring is inserted into the circuit breaker base for operatively coupling the jaw spring to the half jaw. The jaw spring has two symmetrical spring legs, one of the spring legs mechanically cooperating with the single terminal end of the half jaw to apply sliding contact pressure when receiving the bus bar.

In another alternative implementation, a circuit breaker assembly includes a base for receiving internal components of a circuit breaker and a cover for at least partially enclosing the internal components. A half jaw is mounted to the base and has a stationary contact. The half jaw is in electrical contact with the stationary contact and has a single terminal end for electrically contacting a bus bar. A jaw spring is mounted to the base and is operatively coupled to the half jaw. Further, the jaw spring has two symmetrical legs, one of the legs forming a terminal receiving gap with the terminal end for receiving the bus bar.

Additional aspects of the invention will be apparent to those of ordinary skill in the art in view of the detailed description of various implementations, which is made with reference to the drawings, a brief description of which is provided below.

BRIEF DESCRIPTION OF THE DRAWINGS

The invention may best be understood by reference to the following description taken in conjunction with the accompanying drawings, in which.

DETAILED DESCRIPTION OF THE ILLUSTRATED EMBODIMENTS

Although the invention will be described in connection with certain preferred embodiments, it will be understood that the invention is not limited to those particular embodiments. On the contrary, the invention is intended to include all alternatives, modifications and equivalent arrangements as may be included within the spirit and scope of the invention as defined by the appended claims.

Figure 1:
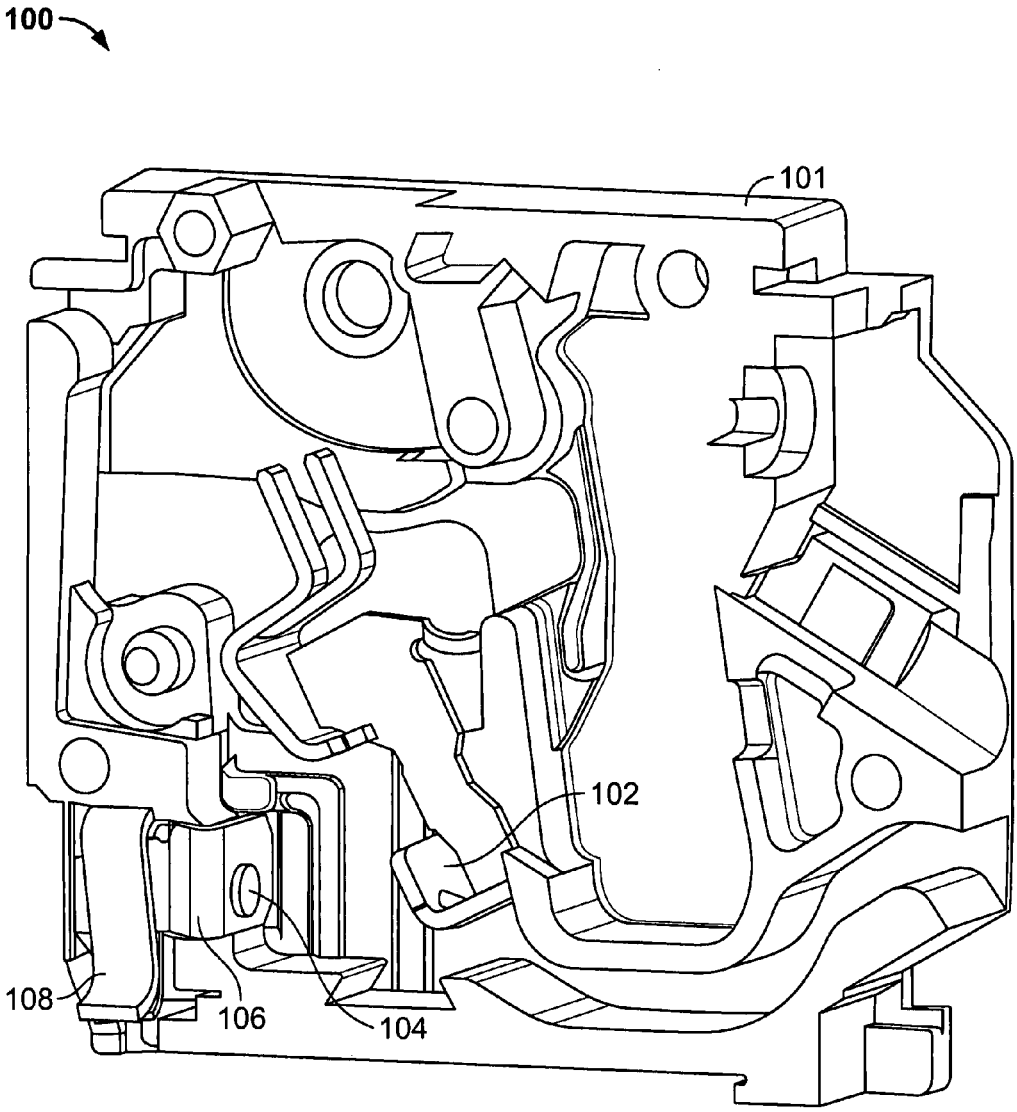
FIG. 1 is a perspective view illustrating a circuit breaker containing a half jaw and a symmetrical jaw spring according to one embodiment.

Turning now to FIG. 1, a circuit breaker 100 includes a base 101 that has mountable positions for receiving a plurality of internal breaker components, including a movable contact 102, a stationary contact 104, a half jaw 106, and a jaw spring 108. In general, most components of the circuit breaker 100 are installed on the base 101 and secured therein after a cover (not shown) is attached to the base 101.

The circuit breaker 100 has several positions, including an ON position, a TRIPPED position, and an OFF position. When the circuit breaker 100 is in the ON position, current flows unrestricted through the circuit breaker 100 and, therefore, through the electrical device or circuit that the circuit breaker is designed to protect. In the ON position, the movable contact 102 is in direct contact with the stationary contact 104.

When the circuit breaker 100 is in the TRIPPED position, current flow through the circuit breaker 100 is interrupted and, consequently, current does not flow through the electrical device or circuit that the circuit breaker is designed to protect. The TRIPPED position is caused by the presence of a current higher than the rated current for the circuit breaker 100 over a specified period of time. When the circuit breaker 100 is in the OFF position, current flow is generally manually interrupted from flowing through the circuit breaker 100. In the TRIPPED and OFF positions the movable contact 102 is separated from the stationary contact 104.

The movable contact 102 is operatively coupled to a trip unit and a switching mechanism (not shown) to interrupt electrical contact when a trip condition occurs. The exposure of the circuit breaker 100 over the specified period of time to a current that exceeds the rated current by a predetermined threshold activates a tripping mechanism. Activation of the tripping mechanism causes the switching mechanism to interrupt current flow through the circuit breaker 100 by separating the movable contact 102 from the stationary contact 104. In FIG. 1, the movable contact 102 is illustrated separated from the stationary contact 104.

The stationary contact 104 is mechanically and electrically coupled to the half jaw 106. Specifically, the stationary contact 104 is a small circular cylinder that is mechanically secured directly to the half jaw 106. The half jaw 106 is inserted into a respective mounting location on the base 100, and the jaw spring 108 is inserted in a partially overlapping position relative to the half jaw 106.

Figure 2A:
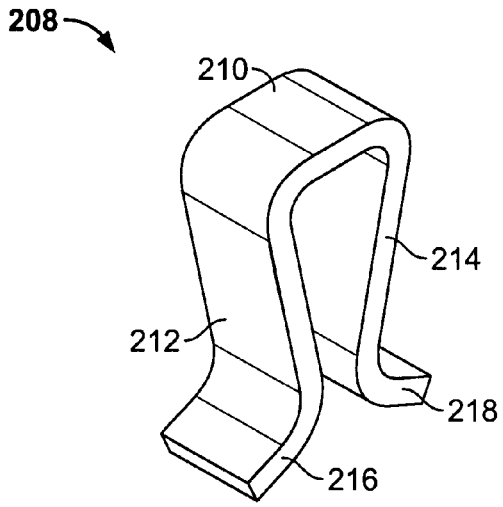
FIG. 2A is a perspective view of the jaw spring.
Figure 2B:
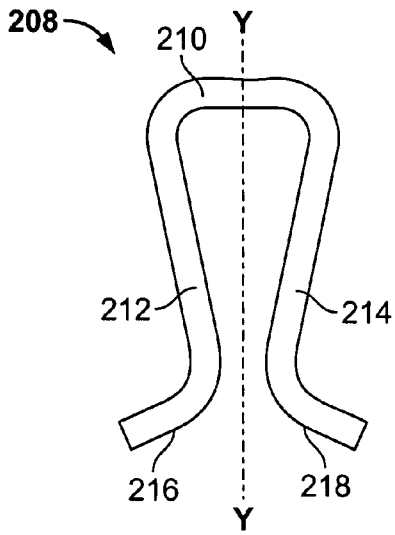
FIG. 2B is a side view of the jaw spring.
Figure 3A:
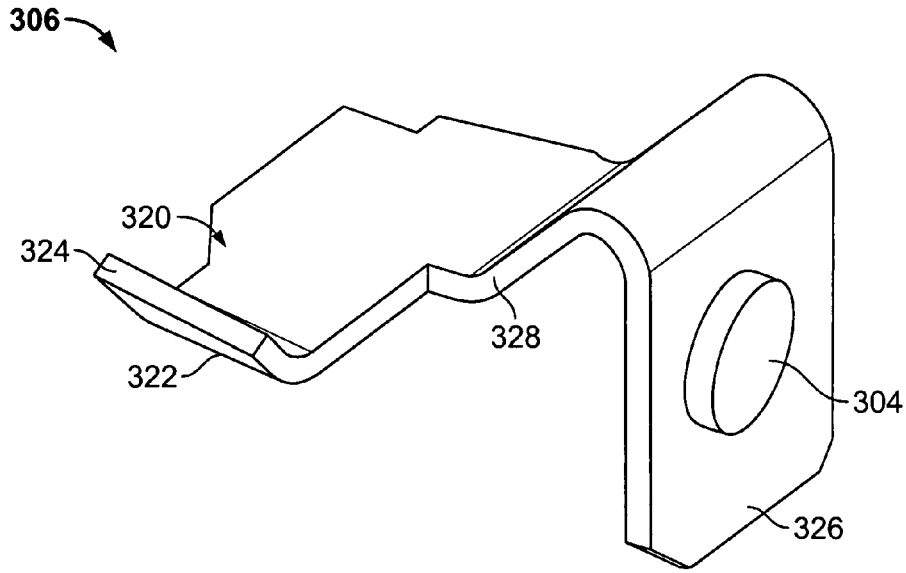
FIG. 3A is a perspective view of the half jaw.
Figure 3B:
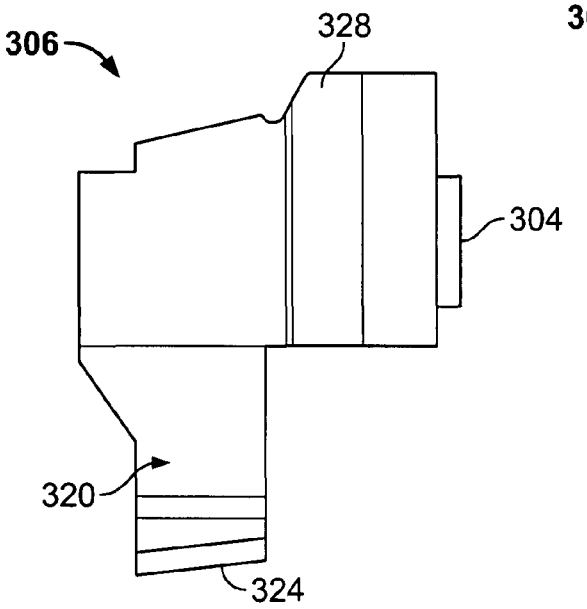
FIG. 3B is a top view of the half jaw.
Figure 3D:
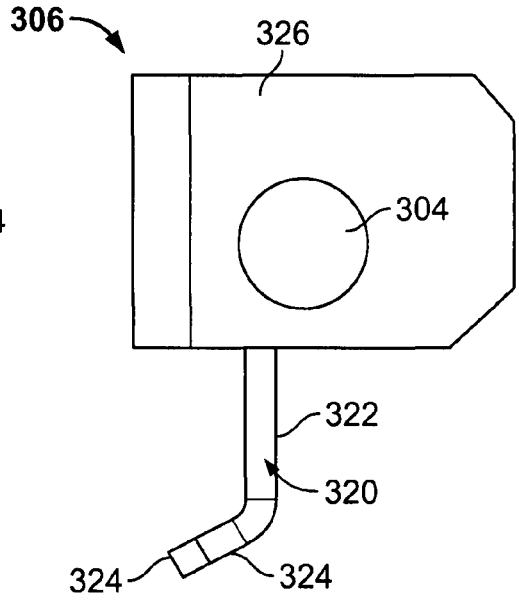
FIG. 3D is a side view of the half jaw.
Figure 3C:
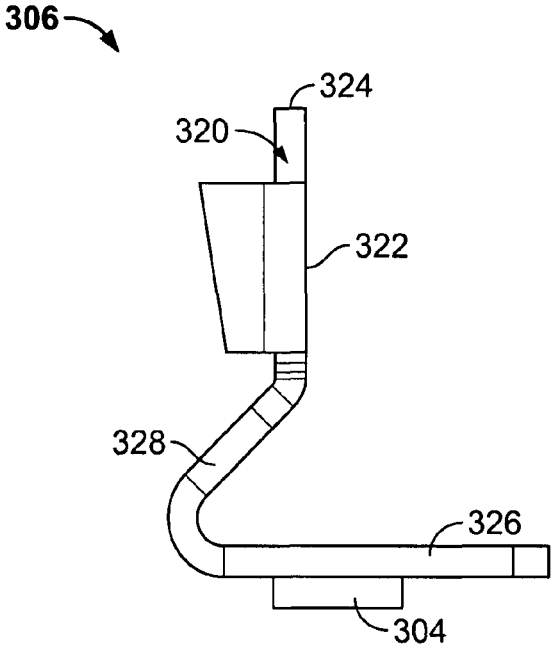
FIG. 3C is a front view of the half jaw.

FIGS. 2A and 2B illustrate a jaw spring 208 in accordance with one implementation of the present invention. According to one embodiment, the jaw spring 208 is a hairpin spring made from a hardened steel material. The jaw spring 208 has a bridge portion 210 centrally located between two spring legs 212, 214. The spring legs 212, 214 are symmetrical about a Y-axis of the jaw spring 208. At the end of each spring leg 212, 214, the jaw spring 208 has an angled receiving surface 216, 218 symmetrically angled about the Y-axis.

FIGS. 3A-3D illustrate a stationary contact 304 connected to a half jaw 306 in accordance with another embodiment. The half jaw 306 is a plug-on type jaw for electrically coupling the circuit breaker, in which it is mounted, to a bus bar. The half jaw 306 has a single terminal end 320 and an internal surface 322, which makes direct contact with the bus bar. According to an alternative embodiment, the half jaw 306 is made from a copper material.

The half jaw 306 inherently provides a reduction in necessary material because it has only one (i.e., a single) terminal end 320. Thus, in contrast to a full jaw (which has two terminal ends), the half jaw 306 considerably reduces the associated material cost.

The single terminal end 320 has an end portion 324 proximate the internal surface 322. The end portion 324 is angled in a direction away from the bus bar, to reduce the possibility of mechanical interference when inserting the bus bar.

The half jaw 306 also has a contact end 326 on which the stationary contact 304 is mechanically and electrically secured. The contact end 326 is connected to the single terminal end 320 via a connecting surface 328, which is generally angled downwards from a top end of the contact end 326. The contact end 326 is positioned generally perpendicular to the single terminal end 320.

Figure 4:
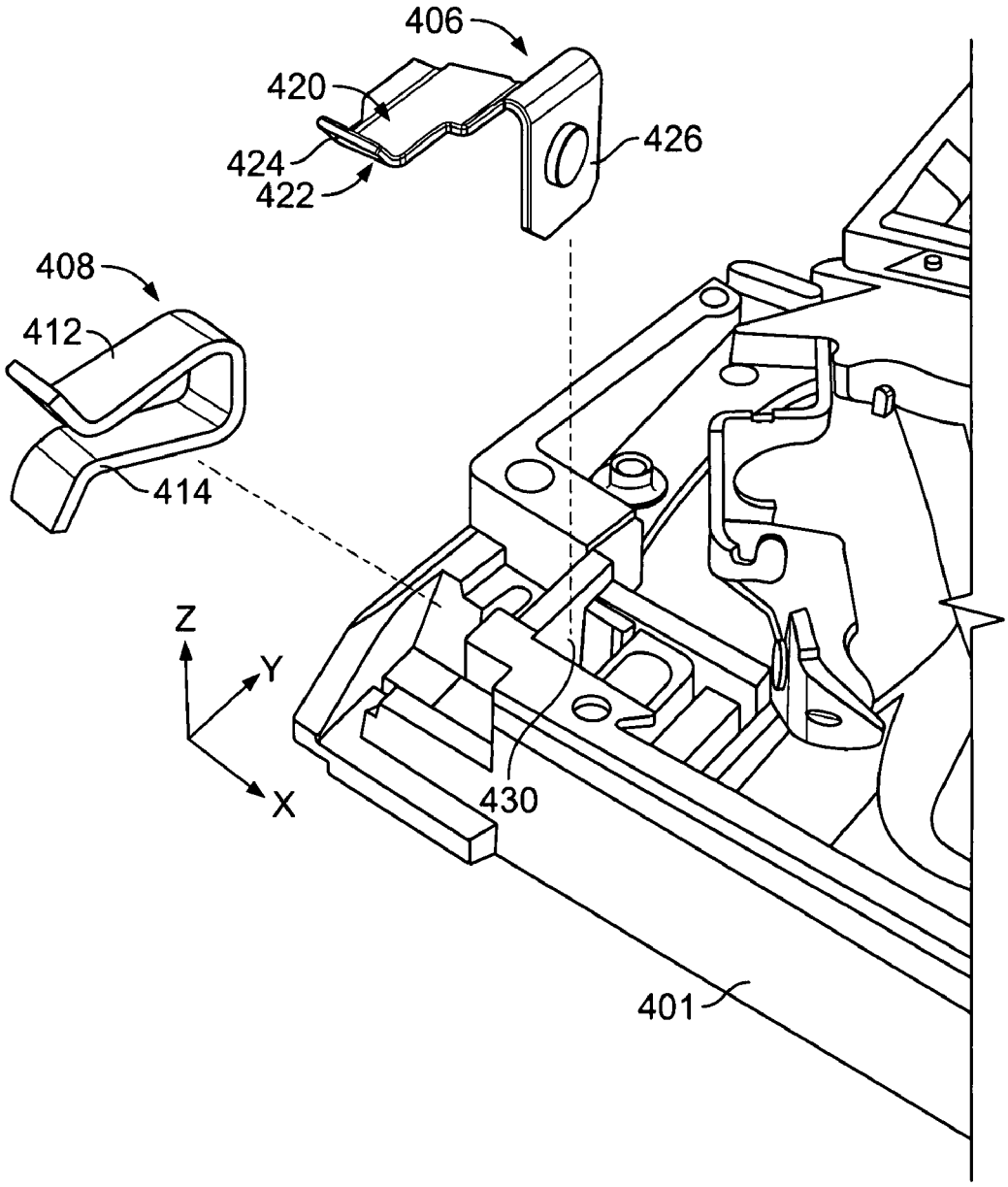
FIG. 4 is an exploded partial perspective view illustrating the assembly of the half jaw and the jaw spring to a circuit breaker base, according to an alternative embodiment.

FIG. 4 illustrates the assembly of a half jaw 406 and a jaw spring 408 to a circuit breaker base 401. The half jaw 406 is inserted along a Z-axis direction into its respective mounting position on the base 401. A contact end 426 of the half jaw 406 slides in over a supporting surface 430 of the circuit breaker base 401. A single terminal end 420 is oriented with its end portion 424 angled away, along the Z-axis direction, from the circuit breaker base 401.

After the half jaw 406 is mounted to the base 401, the jaw spring 408 is inserted along an X-axis direction into its respective position on the circuit breaker base 401. Specifically, an internal surface of one of its two spring legs 412, 414 is positioned in direct contact with an internal surface 422 of the half jaw 406. Thus, the jaw spring 408 partially overlaps the half jaw 406 when mounted in its respective position on the circuit breaker base 401. Because the jaw spring 408 is symmetrical, the orientation of its spring legs 412, 414 about the Y-axis direction is irrelevant. In other words, it is irrelevant whether a first spring leg 412 is up (away from the base 400 along the Z-axis direction) or down (towards the base 400 along the Z-axis direction). Thus, the symmetrical aspect of the jaw spring 408 reduces, or even eliminates, the need to include automated and/or manual assembly rejection features associated with the detection and removal of improperly assembled circuit breakers.

Figure 5:
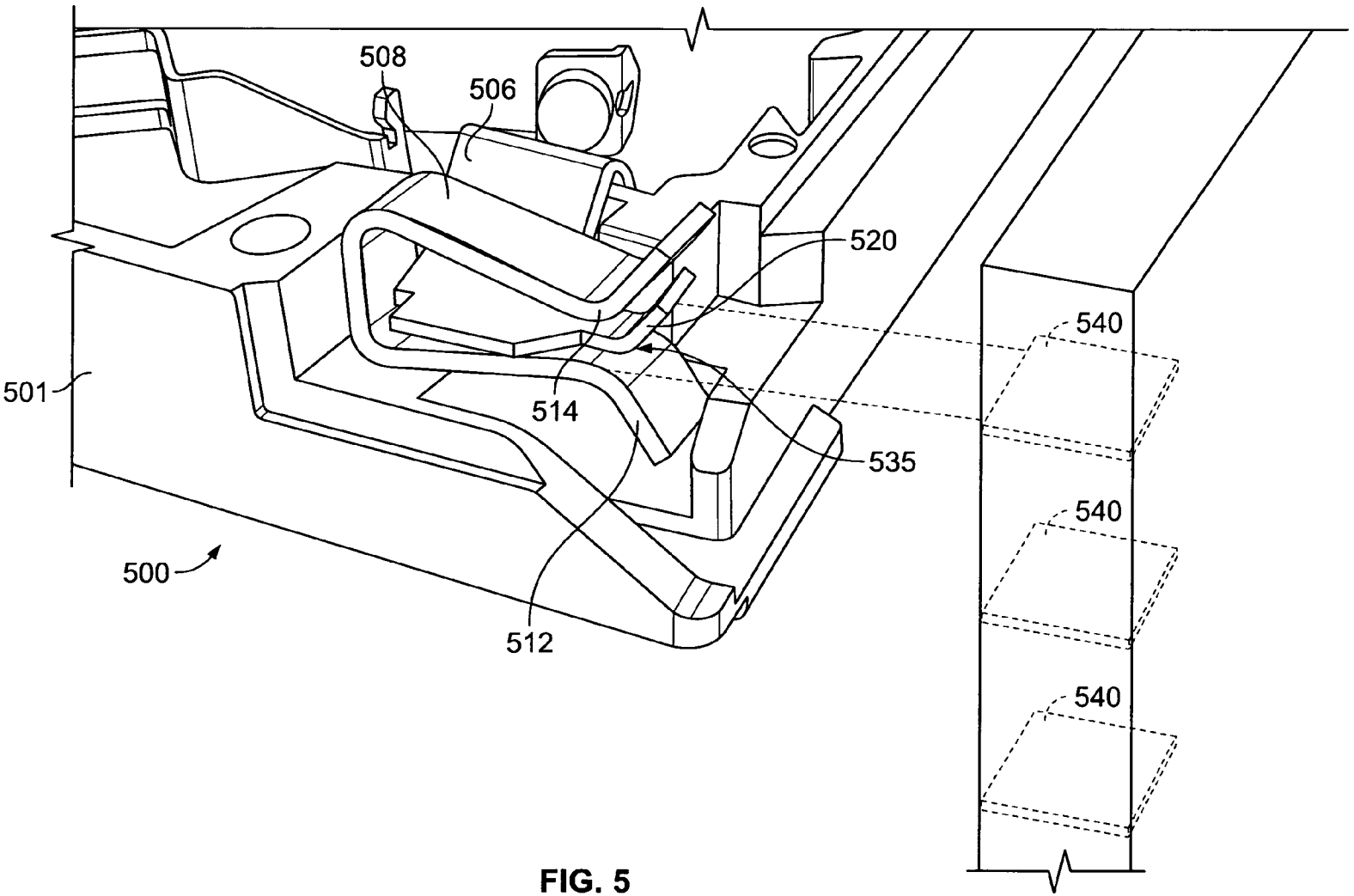
FIG. 5 is an enlarged perspective view illustrating the insertion of a bus bar into the circuit breaker, according to an alternative embodiment.

FIG. 5 illustrates a circuit breaker 500 being electrically connected to a bus bar 540. A base 501 of the circuit breaker 500 contains a half jaw 506 and a jaw spring 508 combination as described in more detail above in reference to FIGS. 1-4. The circuit breaker 500 is installed in the field by positioning it over a desired load center and sliding the bus bar 540 into a receiving gap 535 formed by the half jaw 506 and the jaw spring 508. The sliding contact pressure applied by the jaw spring 508 retains the circuit breaker in mechanical and electrical contact with the bus bar 540. More specifically, one spring leg 512 of the jaw spring 508 cooperates mechanically with a single terminal end 520 of the half jaw 506 and another spring leg 514 of the jaw spring 508 to mechanically hold the bus bar 540 securely in place with respect to the circuit breaker 500. In addition, the mechanical coupling of the bus bar 540 to the circuit breaker 500 provides electrical contact between the bus bar 540 and the half jaw 506.

While particular embodiments, aspects, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A circuit breaker comprising:

a base;

a stationary contact;

a plug-on half jaw mounted to the base and having a contact end on which the stationary contact is mechanically and electrically secured; the half jaw having only a single terminal end that is generally perpendicular to the contact end; and a jaw spring mounted to the base and operatively coupled to the half jaw, the jaw spring having a bridge portion connecting two symmetrical spring legs including a first spring leg and a second spring leg, the bridge portion being located between the base and the single terminal end when the half jaw and the jaw spring are mounted to the base, the jaw spring having a flat surface in which the width is larger than the thickness, the jaw spring including two angled receiving surfaces positioned respectively at an end of one of the spring legs, the receiving surfaces being symmetrically angled with respect to a central symmetry line of the jaw spring such that both receiving surfaces are in the same plane with both spring legs and the central symmetry line;

wherein the first spring leg is positioned in an overlapping position over the single terminal end, the second spring leg being positioned opposite the single terminal end such that a receiving gap is formed for receiving only an electrically conductive end of a bus bar in direct contact with the single terminal end and the second spring leg, the bus bar being mounted external to the circuit breaker.

2. The circuit breaker of claim 1, wherein the stationary contact is mounted in direct contact with an internal surface of the half jaw, the internal surface being positioned proximate to a movable contact of the circuit breaker when the circuit breaker is in an ON position.

3. The circuit breaker of claim 1, wherein the jaw spring includes hardened steel.

4. The circuit breaker of claim 1, wherein the jaw spring is a hairpin spring.

5. The circuit breaker of claim 1, wherein the single terminal end of the half jaw includes an end surface, the end surface being angled such that it is generally parallel to a corresponding one of the receiving surfaces of the jaw spring.

6. The circuit breaker of claim 1, wherein the jaw spring is mountable to its base location independently of the half jaw.

7. The circuit breaker of claim 1, wherein the half jaw includes copper.

8. A method of assembly for a circuit breaker, the method comprising:

electrically and mechanically coupling a contact end of a plug-on half jaw to a stationary contact, the half jaw having only a single terminal end that is generally perpendicular to the contact end;

mounting the half jaw in a circuit breaker base;

inserting a jaw spring into the circuit breaker base for operatively coupling the jaw spring to the half jaw, the jaw spring having a bridge portion connecting two symmetrical spring legs, one of the spring legs mechanically cooperating with the single terminal end of the half jaw to apply sliding contact pressure when receiving only an electrically conductive end of a bus bar that is mounted external to the circuit breaker, the bridge portion being located between the circuit breaker base and the single terminal end when the half jaw and the jaw spring are mounted in the circuit breaker base.

9. The method of claim 8, wherein the inserting of the jaw spring is performed after the mounting of the half jaw in the circuit breaker.

10. The method of claim 8, wherein the mounting of the half jaw includes insertion from a first axis direction, the inserting of the jaw spring being performed from a second axis direction.

11. The method of claim 8, wherein the sliding contact pressure includes securing mechanically and electrically the electrically conductive end of the bus bar to the circuit breaker.

12. The method of claim 8, further comprising positioning the spring legs generally parallel to the single terminal end.

13. The method of claim 8, wherein at least one of the mounting and inserting is an automated assembly step.

14. A circuit breaker assembly comprising:

a base for receiving internal components of a circuit breaker;

a cover for at least partially enclosing the internal components;

a half jaw mounted to the base and having a contact end on which a stationary contact is mechanically and electrically secured, the half jaw having only a single terminal end for electrically contacting an electrically conductive end of a bus bar that is mounted external to the base, the single terminal end being generally perpendicular to the contact end; and a jaw spring mounted to the base and operatively coupled to the half jaw, the jaw spring having a bridge portion connecting two symmetrical legs, one of the legs forming a terminal receiving gap with the terminal end for receiving the electrically conductive end of the bus bar, the bridge portion being located between the base and the single terminal end when the half jaw and the jaw spring are mounted to the base.

15. The circuit breaker assembly of claim 14, wherein the jaw spring is a hardened steel hairpin spring.

16. The circuit breaker assembly of claim 14, wherein the half jaw includes copper.

17. The circuit breaker assembly of claim 14, wherein the jaw spring is mountable to its base location independently of the half jaw.

* * * * *